United States Patent [19]

Spinosa et al.

[11] 4,416,641

[45] Nov. 22, 1983

[54] ANTI-EXPOSURE JACKET

[75] Inventors: Dominic J. Spinosa, Wantagh; Frank Knoll, Huntington Station, both of N.Y.

[73] Assignee: East/West Industries, Inc., Farmingdale, N.Y.

[21] Appl. No.: 297,239

[22] Filed: Aug. 28, 1981

[51] Int. Cl.[3] ..... B63C 9/10

[52] U.S. Cl. ..... 441/94; 441/107; 441/108; 441/116

[58] Field of Search ..... 441/88, 94, 96, 101, 441/102, 106, 107, 108, 113, 116, 118, 122; 405/186; 2/2.1 R, 2.1 A, 81, 82

[56] References Cited

U.S. PATENT DOCUMENTS

| | | | |
|---|---|---|---|
| 252,828 | 1/1882 | Williams | 441/107 |
| 1,252,842 | 1/1918 | Richardson | 441/116 |
| 2,305,606 | 12/1942 | Craig et al. | 441/107 |
| 2,823,396 | 2/1958 | Erickson | 441/94 |
| 3,319,260 | 5/1967 | Cummins | 2/81 |
| 3,441,963 | 5/1969 | Steinthal | 441/107 |
| 3,931,657 | 1/1976 | Jones | 441/116 |
| 4,015,300 | 4/1977 | Hayward et al. | 441/107 |
| 4,097,947 | 7/1978 | Kiefer | 441/116 |
| 4,137,586 | 2/1979 | Evert | 441/107 |
| 4,242,769 | 1/1981 | Rayfield et al. | 2/82 |

*Primary Examiner*—Trygve M. Blix
*Assistant Examiner*—Stephen P. Avila
*Attorney, Agent, or Firm*—Leonard W. Suroff

[57] ABSTRACT

An anti-exposure jacket for covering the torso and arms of the user as well as the user's crotch incorporates insulation material and a removable inflatable bladder disposed between two layers of fire-resistant material. The bladder may be inflated either by a gas-powered valve assembly or by exhalation of the user into an oral valve. Fasteners are provided to store the crotch portion when not in use so that the jacket can be used for routine as well as emergency wear.

11 Claims, 10 Drawing Figures

FIG. 6
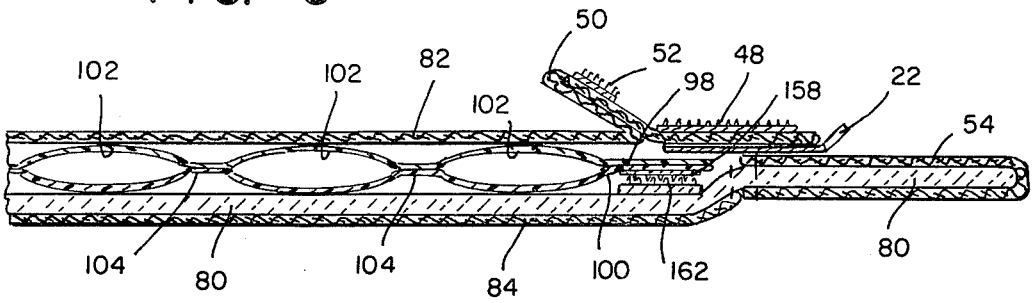
FIG. 7
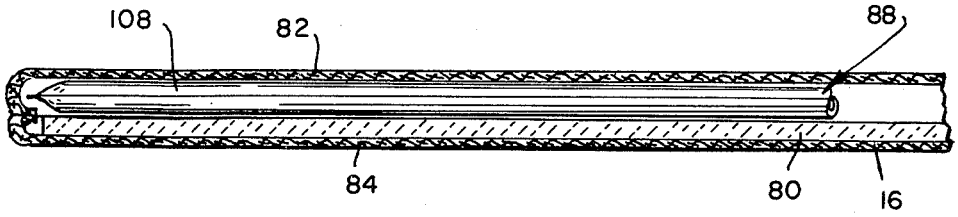
FIG. 8
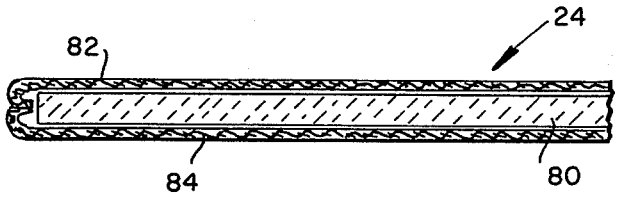
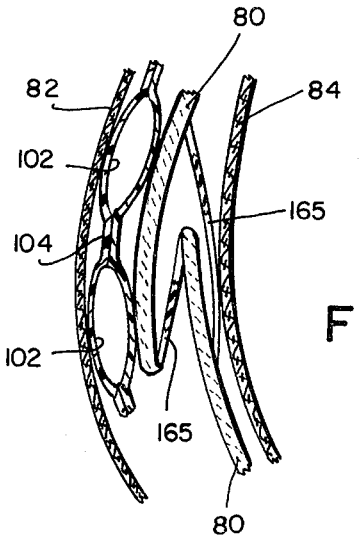
FIG. 10
FIG. 9
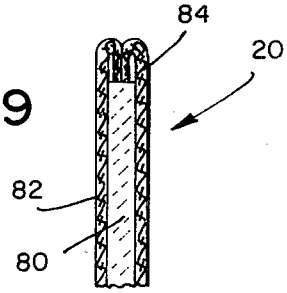

ANTI-EXPOSURE JACKET

BACKGROUND OF THE INVENTION

The present invention relates to garments which are designed to minimize exposure to the elements in emergency situations, and more particularly to an anti-exposure jacket which incorporates flotation and crotch insulation means.

Navy operations are global in nature and can therefore expose aircrewmen to a variety of geographic and climatic extremes. Present and future aircraft deployments indicate the continued need for operation over cold water regions with the continued liklihood of ditching in, or bailouts over below 60° F. (16° C.). In this environment, aircrews and air embarked personnel must have a capability to survive long enough to allow support aircraft efforts a reasonable chance of effecting rescue. The means by which the crewman is afforded the necessary protection to the hazards of cold exposure must in no way or very minimally degrade his effectivness during the inflight portion of the mission.

Accidental immersion in cold water (below 60° F.) has two potentially lethal consequences; drowning or hypothermia. Drowning can be more readily avoided, through the compulsory use of reliably functioning personal flotation equipment. However, hypothermia is more difficult to avoid and for this reason it is recognized as the major problem of accidental immersion in cold water.

The desirability in many instances, of providing a anti-exposure jacket to enhance the survival potential of the wearer is well known. For instance, mobile helicopter crewmen under certain circumstances may be subjected to rapid and generally unexpected placement in frigid waters. It is customary to provide crewmen flotation devices in such cases. These flotation devices and/or other suitable garments provided to crewmen may be insulated in an attempt to decrease exposure of the wearer thereof to the elements.

Unfortunately, most of these exposure reducing and/or flotation garments are especially configured and constructed and are not generally suited for continuous wear. Therefore, in many instances where the need arises for such garments, there is sufficient time for the wearer to dress in such a garment. Furthermore, such insulated garments are usually designed so that they cover only the torso and arms of the wearer.

Heretofore, no means have been provided to properly protect the inner thigh portions and crotch portions of the wearer. It has been discovered that a wearers chance of survival in frigid waters can be greatly enhanced if the wearer's genitals are protected from the cold. To take advantage of this discovery, the present invention overcomes the problems associated with the prior art, as illustrated in U.S. Pat. No. 4,015,300, by providing a garment that can be continuously and comfortably worn by the user and which provides means for insulating the torso, arms, and the critical crotch portion of the wearer from the elements.

OBJECTS OF THE INVENTION

An object of the invention is to provide a garment which insulates the wearer thereof from the elements and which can be worn continuously and comfortably.

Another object of the present invention is to provide a garment which incorporates means for insulating the crotch of the wearer from the elements.

Another object of the present invention is to provide a garment having the aforementioned characteristics which also incorporates flotation means to give the wearer buoyancy to enhance survival potential.

Another object of the present invention is to provide a garment which incorporates flotation enhancing means which as are completely separable from the garment for maintenance purposes.

Another object of the present invention is to provide a garment which is simple in design, rugged in construction, easy to use, adjustable in size, and efficient in operation.

Other objects and advantages of the present invention will become apparent as the disclosure proceeds.

SUMMARY OF THE INVENTION

The present invention provides an anti-exposure jacket which is designed to be worn by the wearer in a manner such that it covers the torso and arms of the wearer. Incorporated in the garment is a flap-like crotch portion that is fixedly secured on the edge thereof to the back of the jacket. The front portion of the flap is pulled between the legs of the wearer and then is fixedly secured to an outer surface of the front of the jacket to position the crotch portion so that it may effectively insulate the crotch of the wearer from the elements. When not in use, the crotch portion can be folded into the interior of the garment where it remains out of the way of the wearer and where it is simultaneously readily accessible if needed.

Flotation means comprising an arm and torso enclosing bladder is disposed within the garment and may selectively be inflated by an oral valve or a gas canister and valve assembly, both the valve assembly and oral valve being operably connected to an inflation chamber formed by the bladder.

The garment of the present invention is substantially similar to conventional outerwear in appearance and incorporates various accouterments such as a front zipper, removable name plate, various pockets, a collar and collar closure means, and means for sealing the ends of the arms of the jacket to preclude the entry of water therein.

The jacket is preferably tailored from fire resistant material and incorporates waterproof insulation in the body and arm portions thereof as well as in crotch means thereof.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout several views and in which:

FIG. 6 is a fragmentary cross sectional view taken substantially through the lines 6—6 of FIG. 3;

FIG. 7 is a fragmentary cross sectional view taken substantially through the lines 7—7 of FIG. 3;

FIG. 8 is a fragmentary cross sectional view taken substantially through the lines 8—8 of FIG. 3;

FIG. 9 is a fragmentary cross sectional view taken substantially through the lines 9—9 of FIG. 3; and FIG. 10 is a fragmentary cross sectional view taken substantially through the lines 10—10 of FIG. 3.

DESCRIPTION OF THE PREFERRED EMBODIMENT

Figure 1:
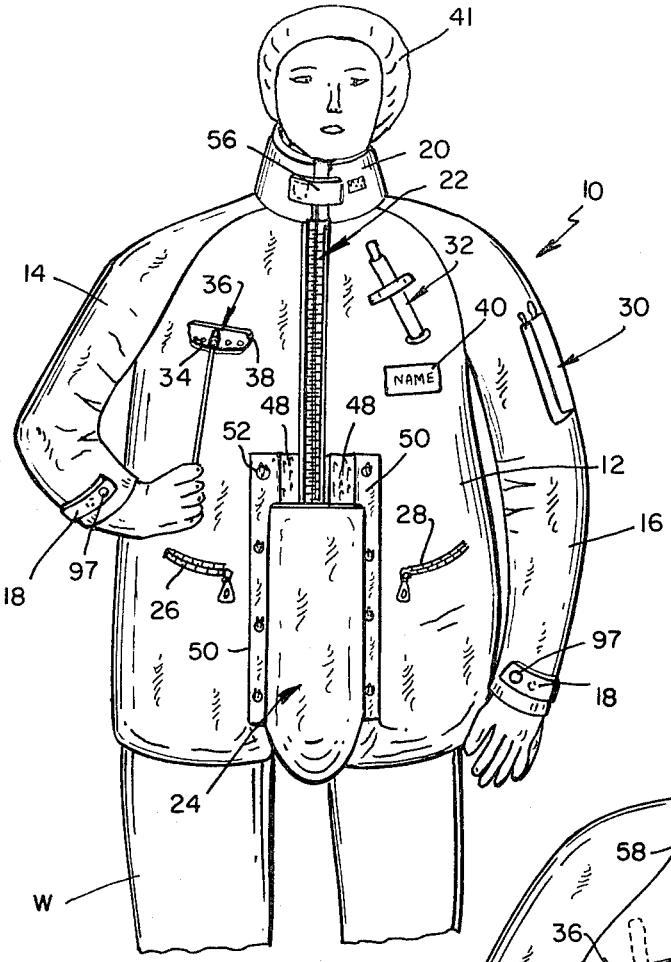
FIG. 1 is a pictorial representation of a wearer wearing a garment incorporating the principles of the present invention.
Figure 2:
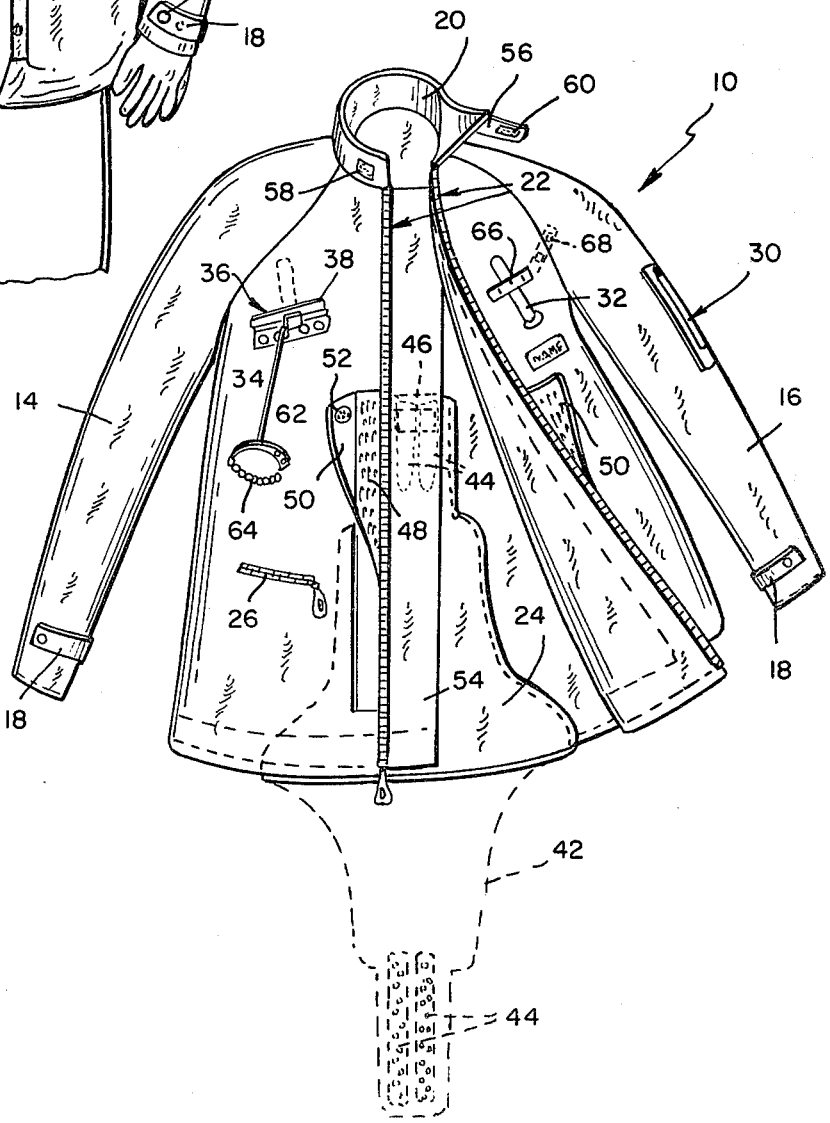
FIG. 2 is a pictorial representation of the garment of FIG. 1 illustrating the storage position of the crotch means of the present invention.
Figure 3:
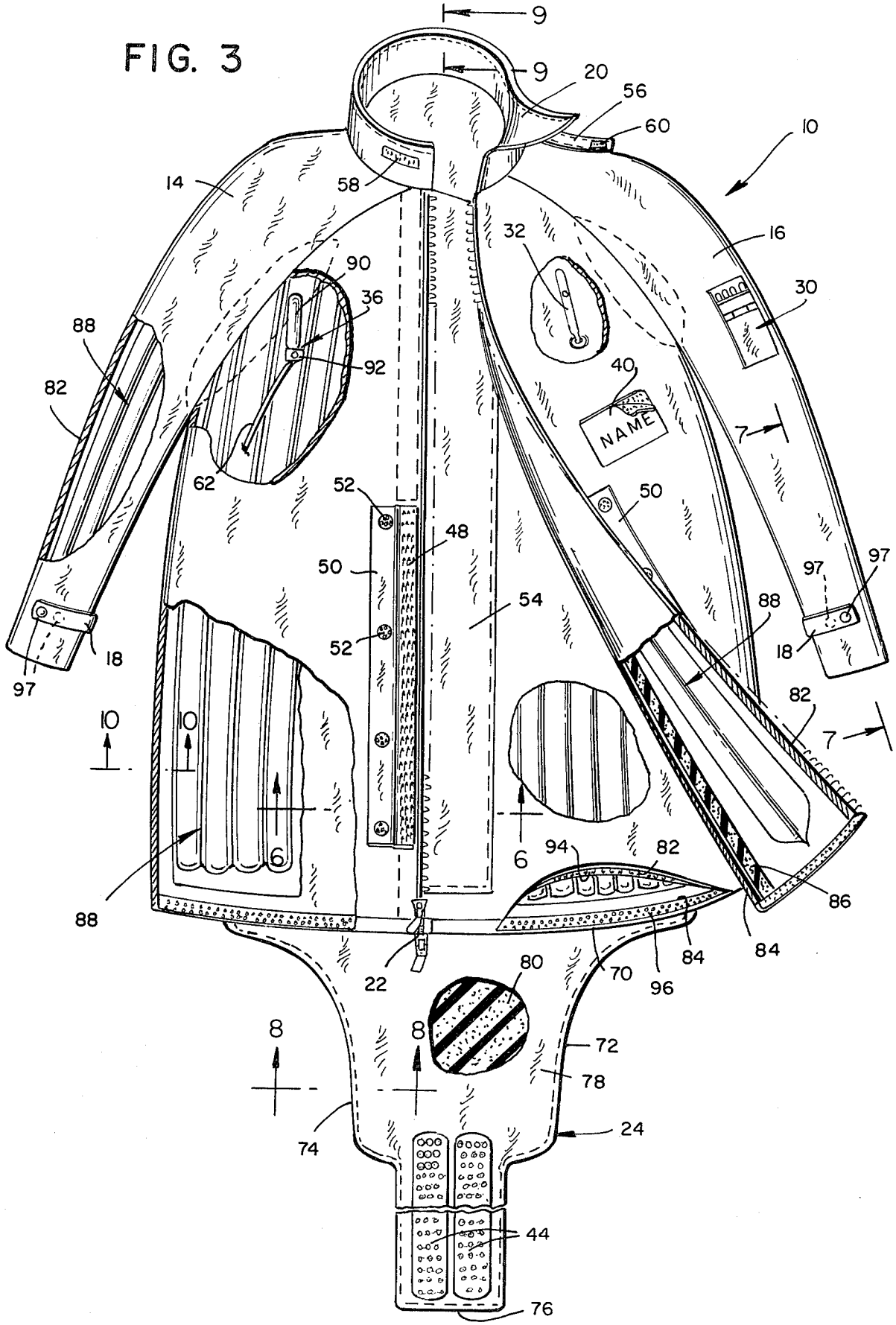
FIG. 3 is a partially broken away pictorial representation of the garment of the present invention.

Referring to the drawings, there is illustrated in FIGS. 1, 2, and 3 a garment in the form of a jacket 10 incorporating the principles of the present invention. The jacket is illustrated as being worn by a wearer W and includes a body portion 12 and a pair of arm portions 14 and 16. The arm portions 14 and 16 cover the arms of the wearer and are provided with constricting straps 18 as hereinafter described. Mounted at the uppermost portion of the jacket 10 and fixedly secured to the body portion 12 thereof is a collar 20. The jacket 10 opens and closes by way of a conventionally located two-way zipper 22. The jacket 10 incorporates a crotch flap 24 which is mounted to the body portion 12 of the jacket 10 so that it resides in between the legs of the wearer W to shield the elements from the crotch and therefore the genitals of the wearer W. The jacket 10 further incorporates a pair of zippered pockets 26 and 28 and a writing implement pocket 30.

Mounted on the front of the body portion 12 is an oral inflation valve 32 which functions as hereinafter described. An aperture 34 is also disposed in the front of the body portion 12 of the jacket 10 and is provided to permit access to a gas inflation assembly 36 which too will be hereinafter described. A flap 38 is provided to cover the aperture 34 when access to the gas inflation assembly 36 is not desired. Also provided on the front of the body portion 12 of the jacket 10 is a name plate 40 which may be removably secured to the jacket 10 such as by hook and loop type fasteners as hereinafter desired. The jacket 10 is also provided with a hood 41 as illustrated in FIG. 1, and may be tucked under the collar 20 when the collar 20 is folded down.

With reference to FIG. 2, the jacket 10 can be observed in a partially open position where the zipper 22 has been separated. The crotch flap 24 is shown in a storage position folded back into the interior of the body portion 22, the crotch flap 24 being secured in position by a suitable fastener. The fastener which mounts the crotch flap 24 in both a use position as illustrated in FIG. 1, and a storage position as illustrated in FIG. 2 comprises a hook and loop type fastener, commonly sold under the trade name Velcro. When the crotch flap 24 is in a downward position as illustrated in FIG. 2 by phantom lines 42 a pair of loop type Velcro fastener strips 44 can be seen fixedly secured to the flap 24. A patch 46 of mating hook type Velcro is fixedly secured to the back interior of the jacket 10 to engage the loop type Velcro fastener strips 44 when the crotch flap 24 is in a storage position.

A pair of strips 48 of hook type Velcro are disposed on each side of the front pieces of the body portion 12 adjacent to the zipper 22 disposed therein and are provided so that they may be positively engaged by the loop type Velcro fastener strips 44 disposed on the crotch flap 24 when the crotch flap 24 is in use, as illustrated in FIG. 1. The strips 48 are covered by flaps 50 when not in use, and the flaps 50 having a plurality of patches 52 of loop type Velcro to secure the flaps 50 in position when not in use. One of the front pieces of the body portion 12 of the jacket 10 includes a tongue 54 which is disposed directly behind the zipper 22 when the sections thereof are engaged and fastened so that leakage of air and water through the zipper 22 can be minimized. The collar 20 includes a strap type fastener 56 having mating Velcro spots 58 and 60 which are complementary and can be engaged so that the wearer can tightly close the collar 20 about his or her neck.

The gas inflation assembly 36 is provided with an activation string 62 and a loop 64 to be gripped by the user and pulled when activation of the gas inflation assembly 36, hereinafter described, is desired. A securing strap 66 is provided to keep the oral inflation valve 32 in a storage position when not in use. The strap 66 is maintained in a storage position by a fastener 68 which may be of Velcro or of another suitable type.

FIG. 3 illustrates the crotch flap 24 and the jacket 10 in greater detail. The crotch flap 24 can be seen to be of a generally triangular shape with the rear edge 70 of the flap 24 being fixedly secured to the lowermost rear edge of the body portion 12. The side edges 72 and 74 of the crotch flap 24 correspond to the side legs of the triangle with the front edge 76 of the crotch flap 24 corresponding generally to the flattened apex of a triangle. The side edges 72 and 74 are contoured to that they conform substantially to the shape of the legs of the wearer when the crotch flap 24 is in use as illustrated in FIG. 1. The crotch flap 24 is formed of two layers of substantially fire resistant material 78 which sandwich therebetween a waterproof insulation material 80. Although this particular composition for the crotch flap 24 is shown, other suitable configurations made of either the same or different materials which provide the function of insulation and shielding of the crotch of the wearer from the weather or elements are to be construed as within the scope of the present invention.

The balance of the jacket including the body portion 12 and arm portions 14 and 16 thereof are also formed from two layers of the preferably waterproof and fire resistant material 82 and 84 forming a chamber therebetween. Sandwiched between the material 82 and 84 is an insulation layer of material 86, which is preferably of the waterproof type. In addition to the insulation 86, there is disposed between the layers of material 82 and 84 in the chamber formed thereby an inflatable bladder 88 which is further illustrated in and will be described in conjunction with FIGS. 4, 5, and 6.

Operably connected to the bladder 88 is the oral inflation valve 32 and the gas inflation assembly 36. The gas inflation assembly 36 includes a gas filled cartridge 90 and lever type puncturing and valve member 92 to which the string 62 is attached. The cartridge 90 is filled with a gas such as carbon dioxide ($CO_2$) which is under pressure. When the string 62 is yanked, it acts upon the assembly 92 to puncture the gas cartridge 90, the gas being released therefrom being directed into the inflation chamber of the bladder 88 to inflate the same. In the event that the gas cartridge 90 and/or the balance of the gas inflation assembly 36 is not functional, air can be channeled to the inflation chamber of the bladder 88 by the oral inflation valve 32. The oral inflation valve 32 is of a type well known in the art and includes a spring loaded mechanism which only permits the passage of air when the mouthpiece thereof is pushed inwardly.

The bladder 88 is entirely removable from the jacket 10 so that the jacket 10 can be maintained through cleaning or the like without possible damage to the bladder 88. Access to the interior of the jacket 10, to the chamber formed between the material 82 and 84, is provided by the lowermost portion of the body 12 being openable. This portion has its bottom edge secured together by a strip 94 of hook type fastener and a strip 96 of loop type fastener for cooperative engagement and disengagement with the hook type fastener 94. Strips 94 and 96 run around the entire length of the bottom edge of the body portion 12 and open and close as desired.

Straps 18 are provided adjacent to the open ends of the arm portions 14 and 16 so that those open ends can be constricted tight against the arms of the wearer to preclude the entry of water. The straps 18 preferably include a plurality of snaps 97 which permit the desired adjustability.

Figure 4:
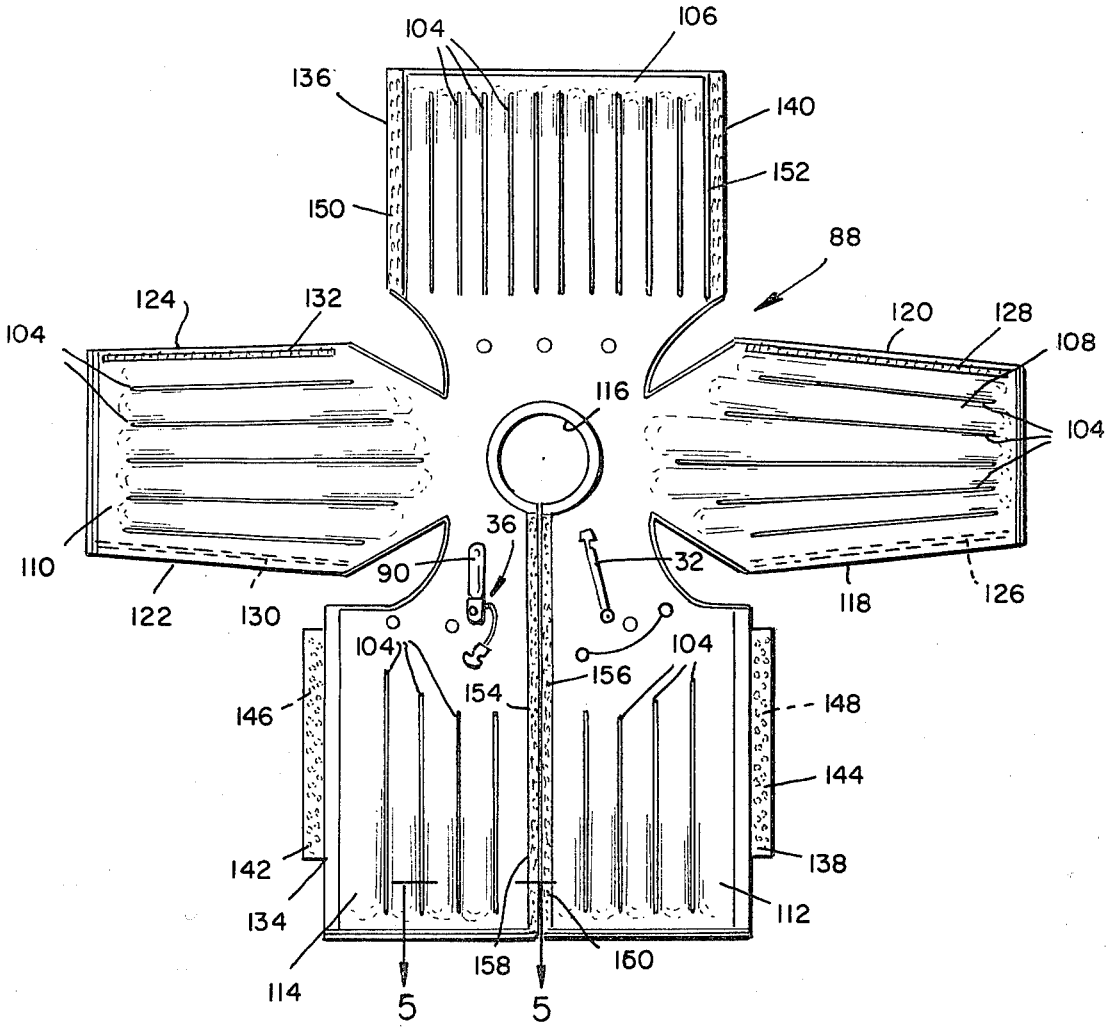
FIG. 4 is a top plan view of the bladder of the present invention.
Figure 5:
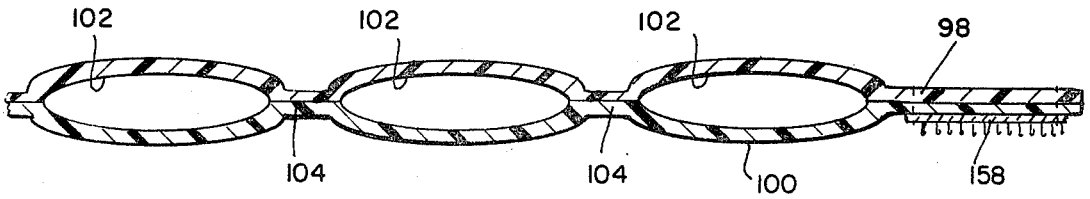
FIG. 5 is a fragmentary cross sectional view taken substantially through the lines 5—5 of FIG. 4.

Referring to FIGS. 4 and 5, it can be seen that the inflatable bladder 88 is formed from two corresponding overlaying sheets 98 and 100 of material which are joined together around the outer and inner edges thereof to form a common inflatable chamber 102. The chamber 102 is partially divided by a plurality of welds or bonds 104 which are placed at various positions about the sheets 98 and 100. The bladder 88 comprises a back section 106, arm sections 108 and 110, and a pair of front sections 112 and 114. The sections 106, 108, 110, 112, and 114 are all joined together around a neck opening 116 and are integrally formed.

When the bladder 88 is inserted between the layers of material 82 and 84, it is formed into a jacket like configuration by the rolling of the arm sections 108 and 110 into tubular sleeve like structures. This is accomplished by bringing the edges 118 and 120 and 122 and 124, respectively, of the arm sections 108 and 110 together to form these sleeve like structures. The arm sections 108 and 110 and their edges, respectively, 118 and 120 and 122 and 124 are joined together by Velcro type fastener strips 126, 128, 130, and 132, disposed, respectively, adjacent to the edges 118, 120, 122, and 124, the strips 128 and 132 being of hook type Velcro material and strips 126 and 122 of mating loop type Velcro material.

The back section 106 of the bladder 88 is folded down and toward the front sections 112 and 114 of the bladder 88 so that the edge 134 of the front section 114 meets the edge 136 of the back section 106 and the edge 138 of the front section 112 meets the edge 140 of the back section 106. The edges 134 and 138, respectively, of the front section 114 and 112 are provided, respectively, with flaps 142 and 144 which have disposed thereon strips 146 and 148 respectively, of loop type Velcro material which mate, respectively, with strips 150 and 152 of hook type Velcro material, disposed, respectively, adjacent to edges 136 and 140 of back section 106.

The inner edges 154 and 156 of the juxtaposed front sections, respectively, 112 and 114 of the bladder 88 have disposed thereon strips 158 and 160 of Velcro, respectively. The strips 158 and 160 of Velcro are provided to engage mating strips of Velcro, not illustrated, disposed between the material 82 and 84 to fix the position of the bladder 88 within the jacket 10. Since the interiors of all the sections 106 through 114 are in communication, when either the oral inflation valve 32 or the gas inflation assembly 36 are employed for inflation, all the sections 106 through 114 are simultaneously inflated. When this is accomplished, the jacket 10 is provided with a significant degree of upright buoyancy and dead airspace. This space as filled does not let water enter the jacket 10. In addition the foam barrier is compressed against the skin for anti-exposure protection.

The manner in which the strips 158 and 160 engage a mating strip can be best seen by viewing FIG. 6. There, strip 158 can be seen engaging a complicity strip 162 mounted on the insulation material 80 disposed between the material 82 and 84. A similar mating strip mounted inside the jacket 10 is provided to mate with strip 162. Other securing strips can be provided as desired. When the bladder 88 is not inflated, the material 82 and 84 can rest relatively near each other to provide a trim jacket.

FIG. 7 which illustrates a cross section of the arm 16 of the jacket 10 and shows the bladder 88 and more specifically the arm section 108 thereof sandwiched between the material 82 and 84 along with the insulation material 80.

Referring to FIGS. 8 and 9, which are cross sections, respectively, of the crotch flap 24 and the collar 20, the compositions thereof are further illustrated. Insulation material 80 is shown sandwiched between material 82 and 84.

Although the present invention has been described as employing numerous Velcro type fasteners, it is to be understood that other suitable fasteners well known in the art may be employed as substitutes therefor or in conjunction therewith.

For instance, zippers, hooks and eyes, buttons, or the like can be employed within the principles and scope of the present invention. Additionally, the fabric or material specified as fire resistant and the insulation specified as waterproof, may be substituted for as selected from a wide range of materials well known to those in the art having either similar or different properties. For instance, the flame resistant material may be nomex treated nylon, canvas, or the like and the insulation can be of a foam or other consistency. It is also to be understood that the accouterments of the present invention such as pockets, straps, etcetera hereinbefore described may be variously relocated and repositioned as desired within the principles and scope of the present invention.

FIG. 10 illustrates that the adjustable feature of the invention is provided to adjust to various body sizes of the user or wearer W. The body portion 12 may include insulation material 80 that is connected by elastic means 165 in the form of elastic strips or elements adapted to expand depending upon the girth of the wearer. The material 82 and 84 are formed on opposite sides of the foam insulation material 80 with the inflatable chamber 102 contained therebetween.

Although an illustrative embodiment of the invention has been described in detail herein with reference to the accompanying drawings, it is to be understood that the invention is not limited to the precise embodiment, and that various changes and modifications may be affected therein without departing from the scope and spirit of the present invention.

What is claimed is:

1. A garment for protecting the wearer thereof from exposure to the elements comprising:

A. a jacket having a body portion tailored to fit the torso of said wearer and arm portions for covering the arms of said wearer, said jacket body and arm portions including;

(i) an inner and outer layer of material forming a chamber therebetween, (ii) fastening means disposed about the edges of said body portion and at specific locations on the inner rear and front outer surfaces of said body portion, said arm portions being sealed at the edges thereof, and (iii) crotch means having one end affixed to the lower edge of said outer layer of material, said crotch means being positionable between the legs of said wearer with the other end thereof fastened to said front outer surface of said body portion when in use and being fastened in position at the inner rear surface of said outer layer of material when not in use;

B. insulation means affixed to the outer surface of said inner layer of material and disposed within said chamber, formed by said inner and outer layers;

C. inflatable bladder means including;

(i) a back section having fastening means along its side edges, (ii) a pair of arm sections having fastening means along its side edges, and (iii) a pair of front sections having fastening means, all of said sections being joined together about the periphery of a neck opening, said arm sections being adapted to be rolled and joined at said arm section fastening means into tubular sleeves, said back section being additionally joined to said front section by cooperation of their respective fastening means, said bladder means being adapted to be received within said chamber between said insulation means and the inner surface of said outer layer of material; and D. means for inflating said bladder means.

2. A garment according to claim 1 wherein the side edges of said crotch means are shaped to substantially conform to the contours of the legs of said wearer thereof.

3. A garment according to claim 2 wherein said crotch means includes at least two layers of fire-resistant material with waterproof insulating material disposed therebetween.

4. A garment according to claim 1 wherein said inner and outer layers of material are fire-resistant material and said insulating means disposed therebetween includes waterproof material.

5. A garment according to claim 1 wherein said bladder means is formed from two unitary corresponding overlaying sheets of material joined together to form an inflatable chamber therebetween.

6. A garment according to claim 1 wherein said inflating means is readily accessible through said outer layer of material and said insulating means.

7. A garment according to claim 1 further including additional fastening means disposed on the inner surface of said outer layer of material and on the outer surfaces of said bladder means for removably holding and positioning said bladder means within said chamber.

8. A garment according to claim 1 wherein said fastening means is non-metallic.

9. A garment according to claim 6 wherein said additional fastening means is non-metallic.

10. A garment according to claim 1 wherein said inflating means comprises an oral valve.

11. A garment according to claim 1 wherein said inflating means comprises a pressurized gas-filled cannister.

* * * * *